US006872086B2

(12) United States Patent
Milan

(10) Patent No.: US 6,872,086 B2
(45) Date of Patent: Mar. 29, 2005

(54) POP-OUT OUTLETS FOR HOUSINGS

(76) Inventor: Henry Milan, 1709 Apple Ridge Ct., Rochester Hills, MI (US) 48306

( * ) Notice: Subject to any disclaimer, the term of this patent is extended or adjusted under 35 U.S.C. 154(b) by 25 days.

(21) Appl. No.: 10/696,987

(22) Filed: Oct. 30, 2003

(65) Prior Publication Data

US 2004/0142587 A1 Jul. 22, 2004

Related U.S. Application Data

(62) Division of application No. 10/313,312, filed on Dec. 6, 2002.
(60) Provisional application No. 60/338,299, filed on Dec. 6, 2001.

(51) Int. Cl.[7] ..... H01R 13/44
(52) U.S. Cl. ..... 439/131
(58) Field of Search ..... 439/131, 650–654, 439/32, 33, 140, 925; 174/57

(56) References Cited

U.S. PATENT DOCUMENTS

| | | | | | |
|---|---|---|---|---|---|
| 2,196,842 | A | | 4/1940 | Strazzabosco | |
| 5,658,152 | A | * | 8/1997 | Selker | 439/31 |
| 5,899,761 | A | * | 5/1999 | Crane et al. | 439/142 |
| 6,290,517 | B1 | * | 9/2001 | Anderson | 439/131 |
| 6,290,518 | B1 | | 9/2001 | Byrne | |
| 6,478,587 | B2 | | 11/2002 | Sharples | |
| 6,568,946 | B1 | * | 5/2003 | Chou | 439/131 |

* cited by examiner

*Primary Examiner*—Ross Gushi
(74) *Attorney, Agent, or Firm*—MacMillan, Sobanski & Todd, LLC

(57) ABSTRACT

An electronic housing device has at least one extendable housing portion provided with electrical connectors and being selectively movable into and out of an opening in a housing of the device. At least one of the connectors can be accessible when the housing portion is retracted and the housing can also be provided with additional accessible electrical connectors.

18 Claims, 11 Drawing Sheets

ELECTRICAL SCHEMATIC 29
30
9 MOV SURGE PROT. BD.
L-OUT
L-IN
N-IN
G-IN
35
MODULE WITH POP-OUT OUTLETS
50
34
54
33
52
120 VAC
U1 PLUG
NOTE: A 3 MOV SURGE PROT. BD. REQUIRES THE PARTS C1, F2 F3, M1, M7, & M8
EXTENDED POP-OUT OUTLETS (4 OUTLETS PER POP-OUT)
32
INSET POP-OUT OUTLETS
31
SW1 SW W/BRKR
MODULE WITH POP-OUT OUTLETS
DIAGRAMATIC VIEW

POP-OUT OUTLETS FOR HOUSINGS

CROSS-REFERENCE TO RELATED APPLICATION

This application is a division application of the co-pending U.S. patent application Ser. No. 10/313,312, filed Dec. 6, 2002.

This application claims the benefit of U.S. provisional patent application Ser. No. 60/338,229 filed Dec. 6, 2001.

BACKGROUND OF THE INVENTION

1. Field of the Invention

The present invention relates generally to housings, and more particularly to pop-out or pop-up outlets for electronics housings, and most particularly to pop-out or pop-up outlets for surge protection devices.

2. Discussion of the Related Art

Electrical outlets on electronics housings are well known in the art. Surge protection devices are also well known in the electronics art as being desirable and/or necessary for protecting sensitive electronic devices from surges of current: whether over line cords, telephone lines, or other connections. A common problem with electronics housings and surge protection devices of all types is they never seem to have enough outlets to protect the desired number of devices.

The electronics housings and surge protectors known in the art generally have a fixed number of outlets or receptacles, or require nodules to be added to provide additional outlets or receptacles. This may increase the size of the housing or the surge protection device, and may increase the overall cost of the housing or surge protection device. Thus, those skilled in the art have continued to search for ways to have additional outlets or receptacles present which do not take up space when not needed, and do not require the addition of modules or other devices to the basic housing or surge protector device.

SUMMARY OF THE INVENTION

The present invention solves the problems present in the art by providing pop-up, pop-out or otherwise extendable outlets for electronics housings and surge protection devices such as, for example, line cord surge protectors, telephone line surge line protectors, network surge protectors, co-ax surge protectors, and other types of surge protectors known in the art. With the pop-out outlets in their retracted position, the overall size of the device is not increased, and when the pop-out outlet is "popped-out" of the housing to expose additional outlets or connectors, only then is the size of the device increased, and without additional cost.

Thus, it would be advantageous to provide additional pop-out outlets or connectors in an electronics housing or surge protection device.

Further advantages of the present invention will be apparent from the following description and appended claims, reference being made to the accompanying drawings forming a part of the specification, wherein like reference characters refer to corresponding parts in the several views.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
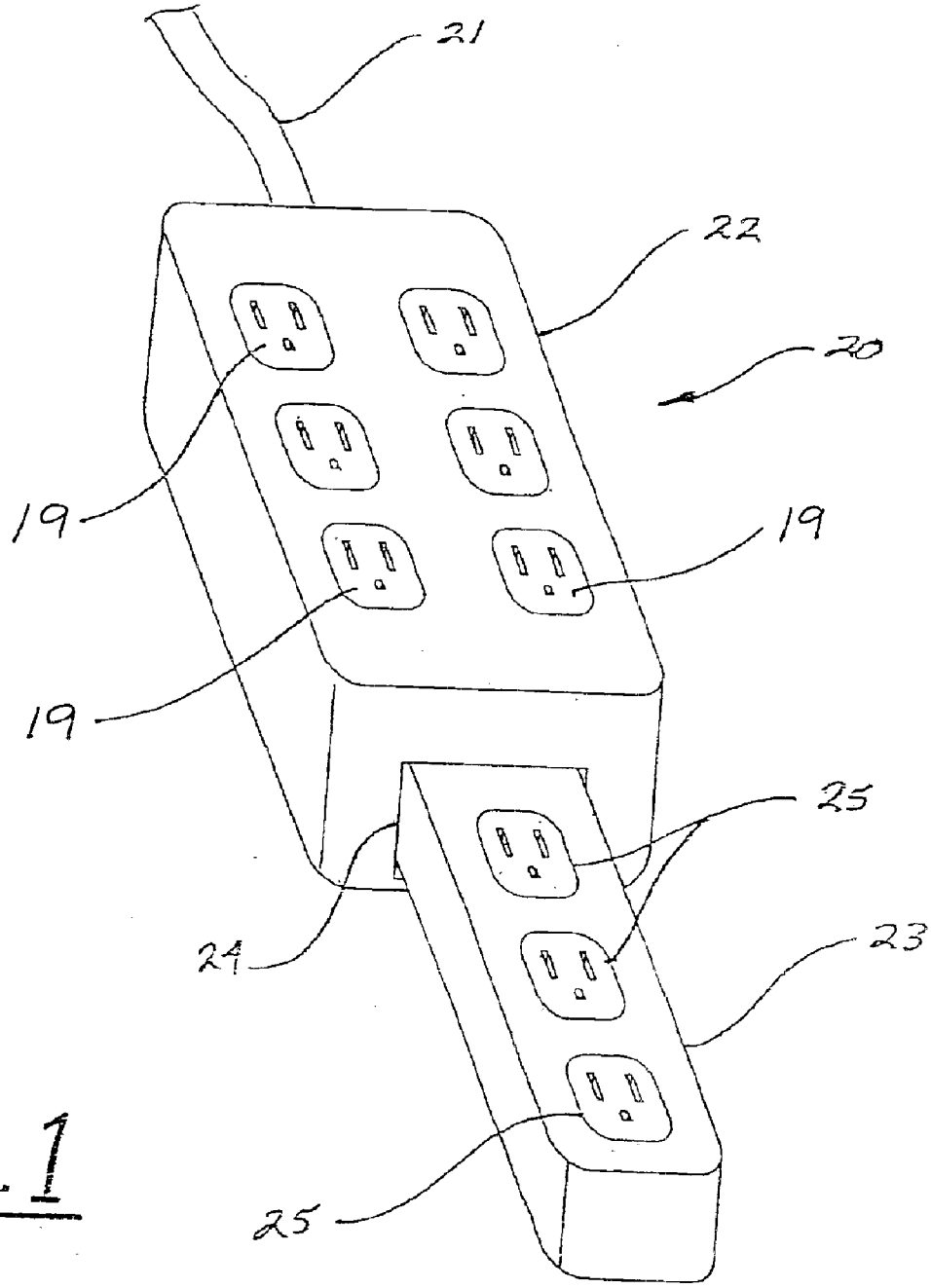
FIG. 1 is a perspective view of a construction embodying the present invention.

Referring now to FIG. 1, there is shown a surge protection or other electronic housing device, generally designated by the numeral 20, for example, for protecting devices connected to line current from electrical surges. There is shown a line cord 21 for connection to a source or power and a surge protector housing 22 having a plurality of electrical outlets or connectors 19 to receive a standard three-prong line cord plug (not shown).

Figure 8:
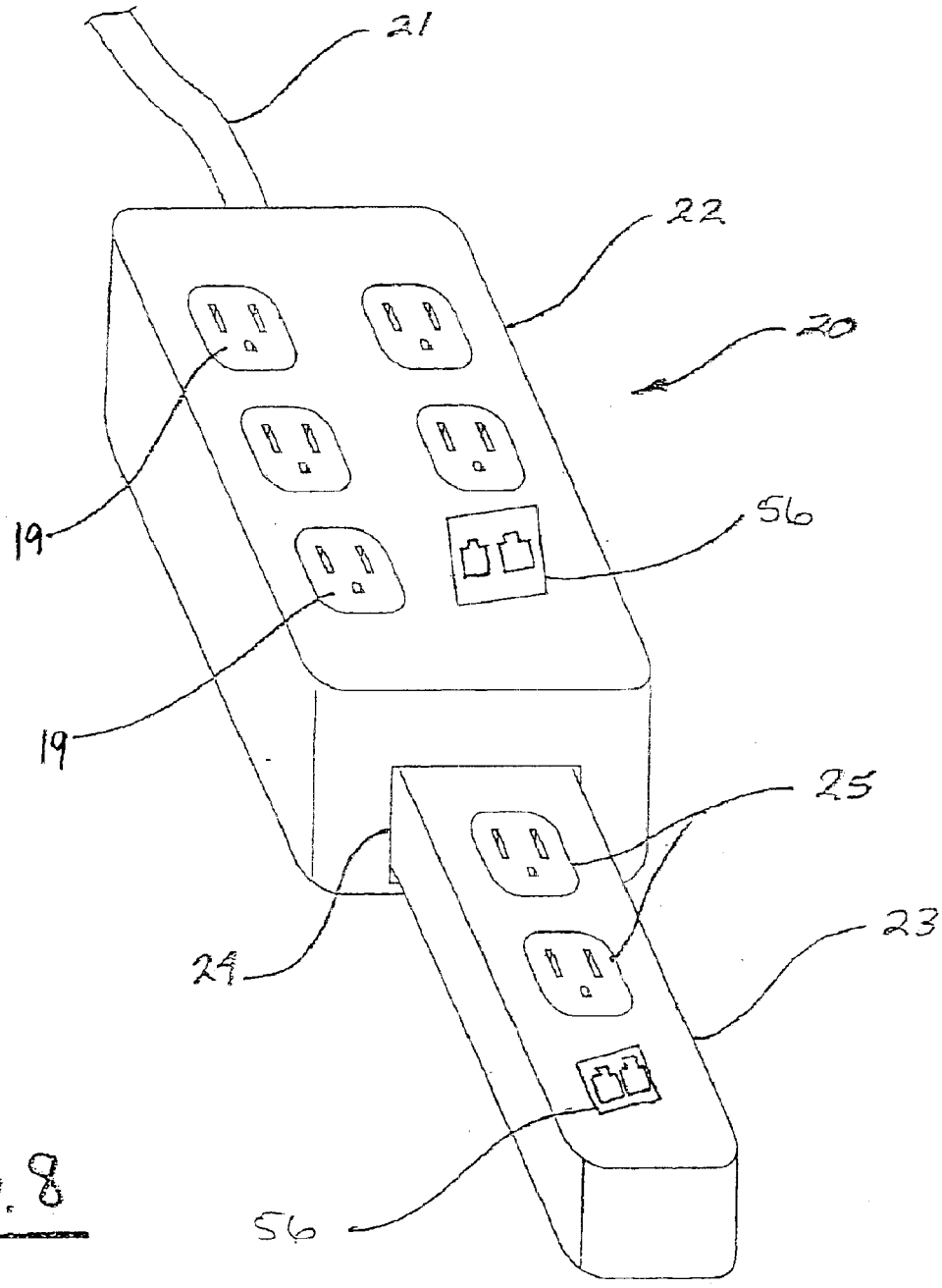
FIG. 8 is a perspective view of a construction embodying the present invention.
Figure 9:
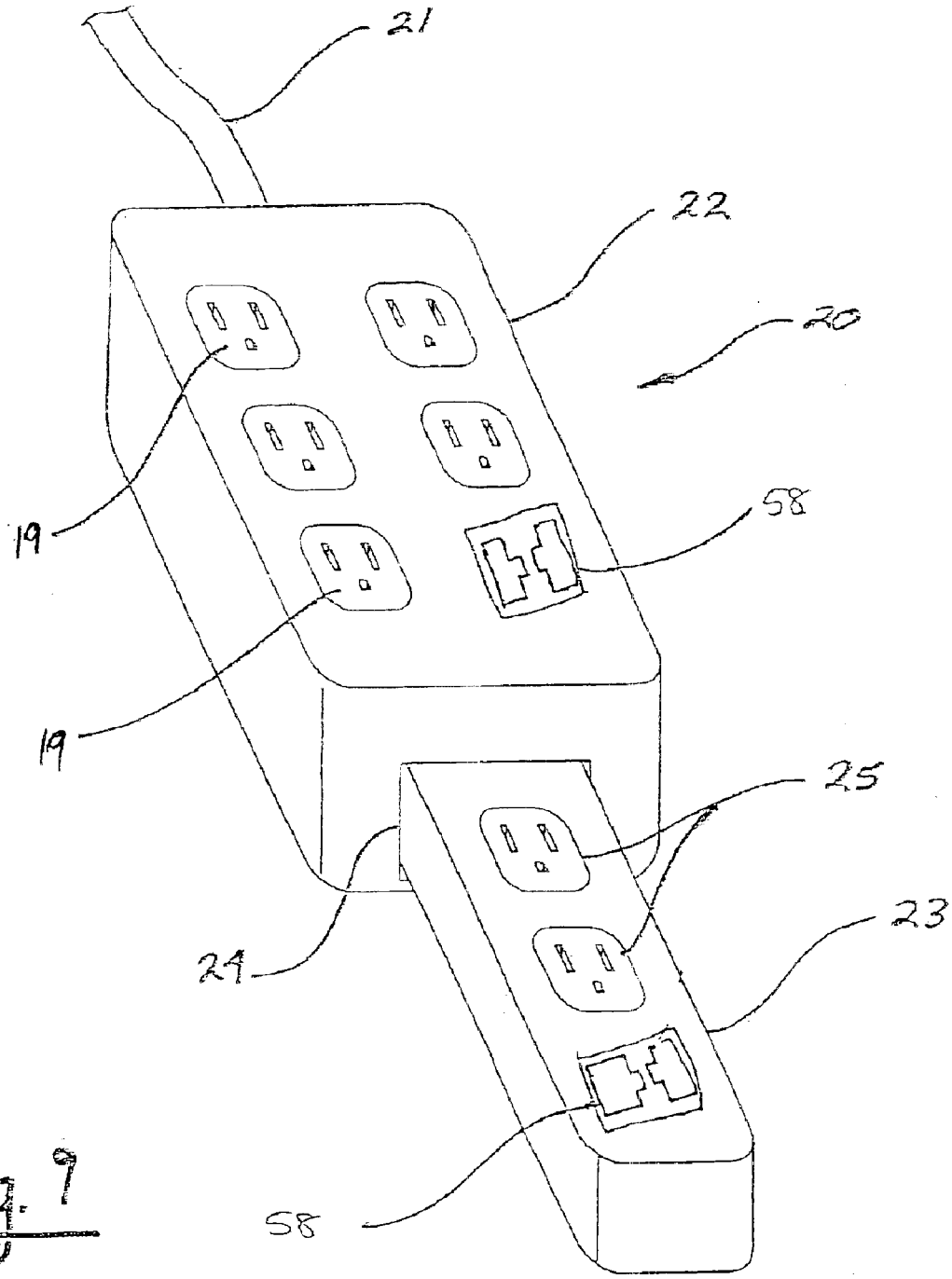
FIG. 9 is a perspective view of a construction embodying the present invention.
Figure 10:
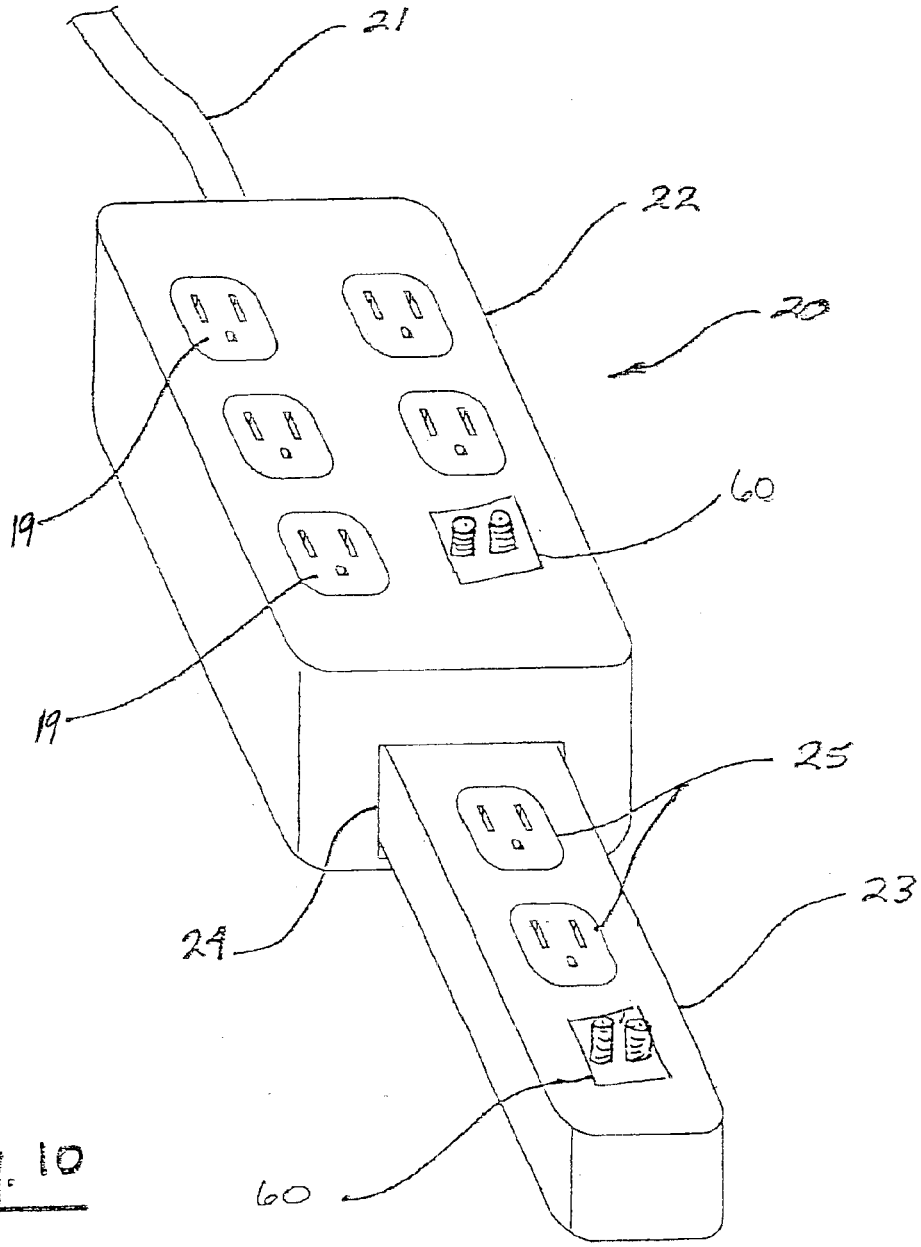
FIG. 10 is a perspective view of a construction embodying the present invention.
Figure 11:
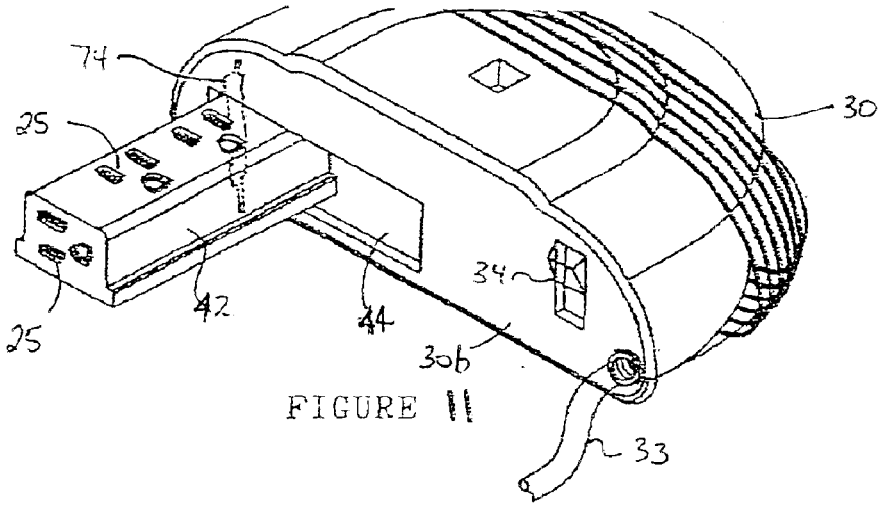
FIG. 11 is a perspective view of a construction embodying the present invention.
Figure 12:
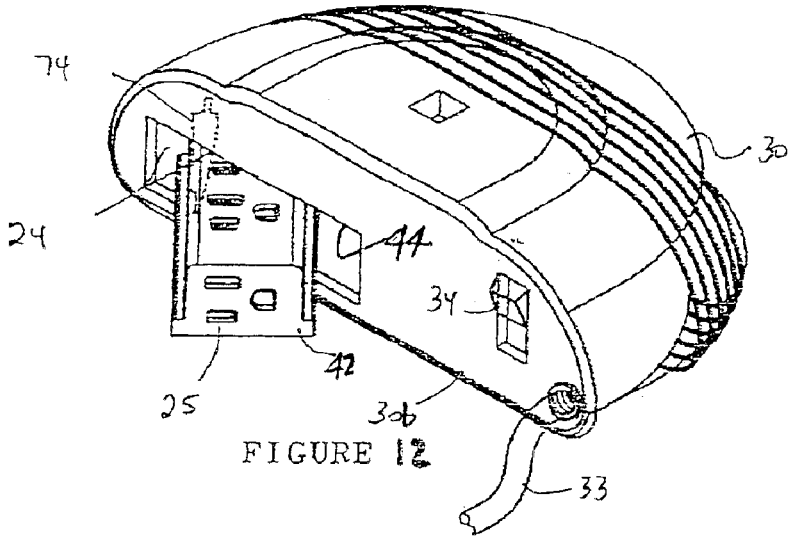
FIG. 12 is a perspective view of an alternative condition of the construction shown in FIG. 11.
Figure 13:
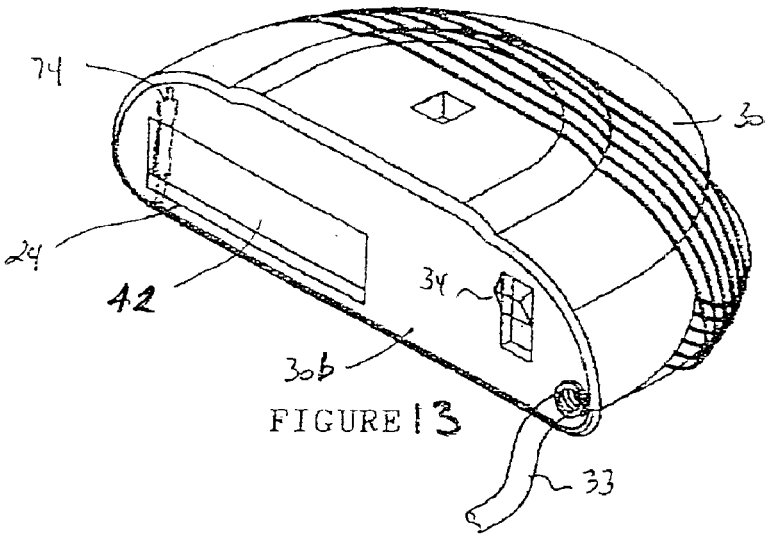
FIG. 13 is a perspective view of an alternative condition of the construction shown in FIG. 11.
Figure 14:
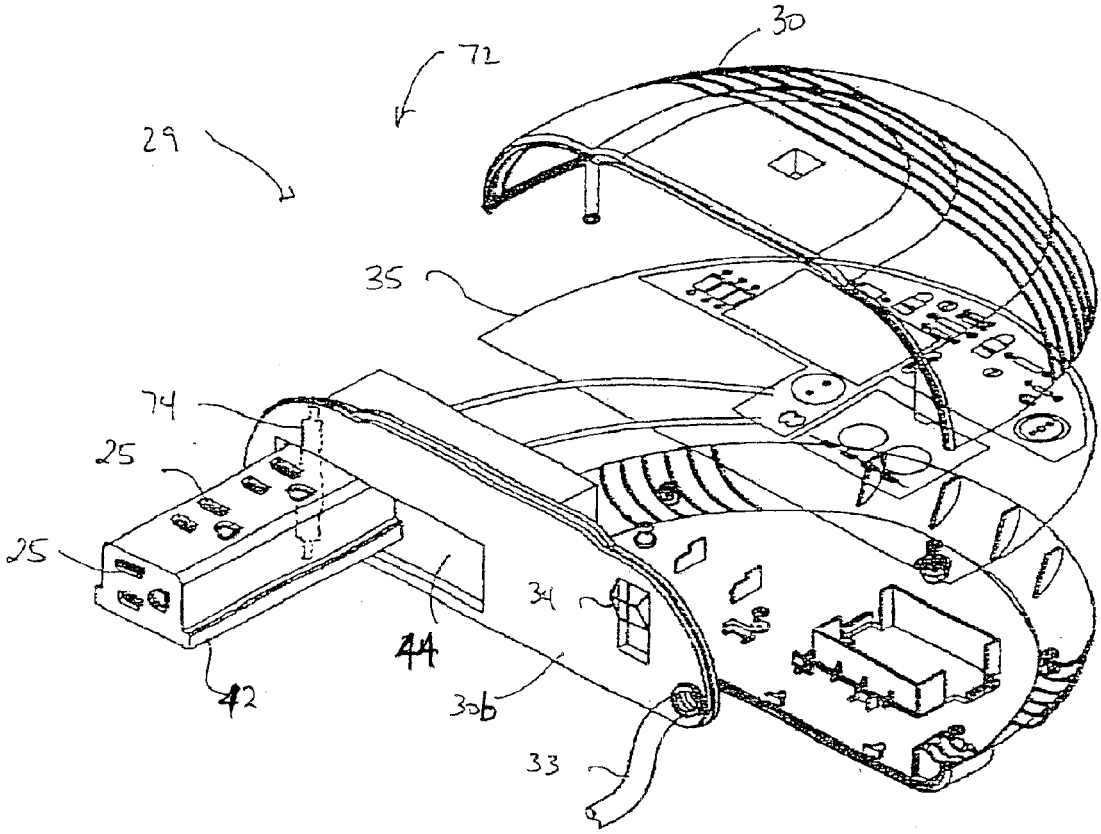
FIG. 14 is an exploded perspective view of the construction shown in FIG. 11.

It should be understood than the present invention may be used for any electronics housing 22. By way of example only, an electronics housing having surge protection located therein will be described. It should also be understood that the present invention is not limited to providing additional line cord outlets, but is broad in scope and is intended to provide additional pop-out electrical outlets or connectors of any kind, such as RJ11 56 (FIG. 8), RJ45 58 (FIG. 9) and co-ax 60 (FIG. 10) connectors, needed to protect any type of electrical devices from surges. Such pop-out outlets or connectors are well within the scope of the present invention.

By way of the present example, surge protector housing 22 has at least one extendable housing portion 23 which slides in and out of an opening 24 provided on the housing 22. A further plurality of electrical outlets or connectors 25 are formed in the top planar surface of the extendable housing portion 23 and may be of any desired type or number. Preferably, at least one electrical connector 25 is exposed when the extendable housing portion 23 is retracted into the housing such as in the embodiment depicted in FIGS. 2 and 3.

Figure 2:
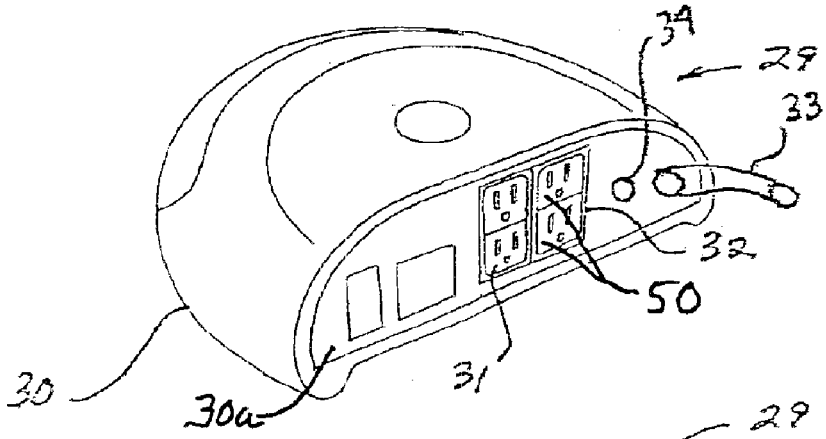
FIG. 2 is a perspective view of a modification of the present invention showing two pop out outlets, both in their retracted position.
Figure 3:
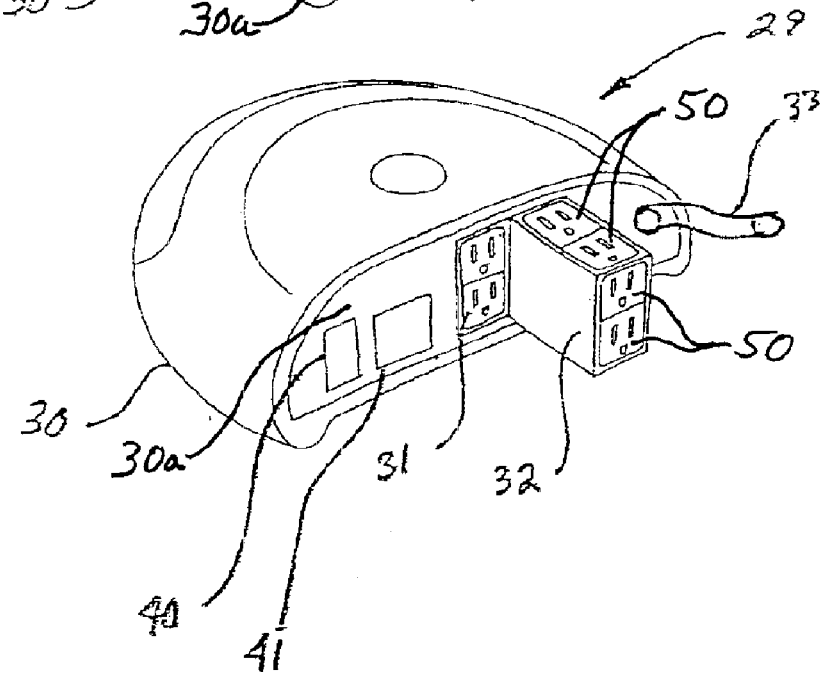
FIG. 3 is a perspective view of the construction shown in FIG. 3 with one of the pop out outlets or connectors shown in its extended or popped-out position.

As an example of the wide range of surge protection devices which are within the scope of the present invention, there is shown in FIG. 2 and FIG. 3 a perspective view of another electronic housing device in the form of a base unit for a stackable USB hub 29, which may be such as shown in applicant's application Ser. No. 60/169,055, now U.S. Pat. No. 6,607,408, which is incorporated herein by reference.

Figures 4, 5:
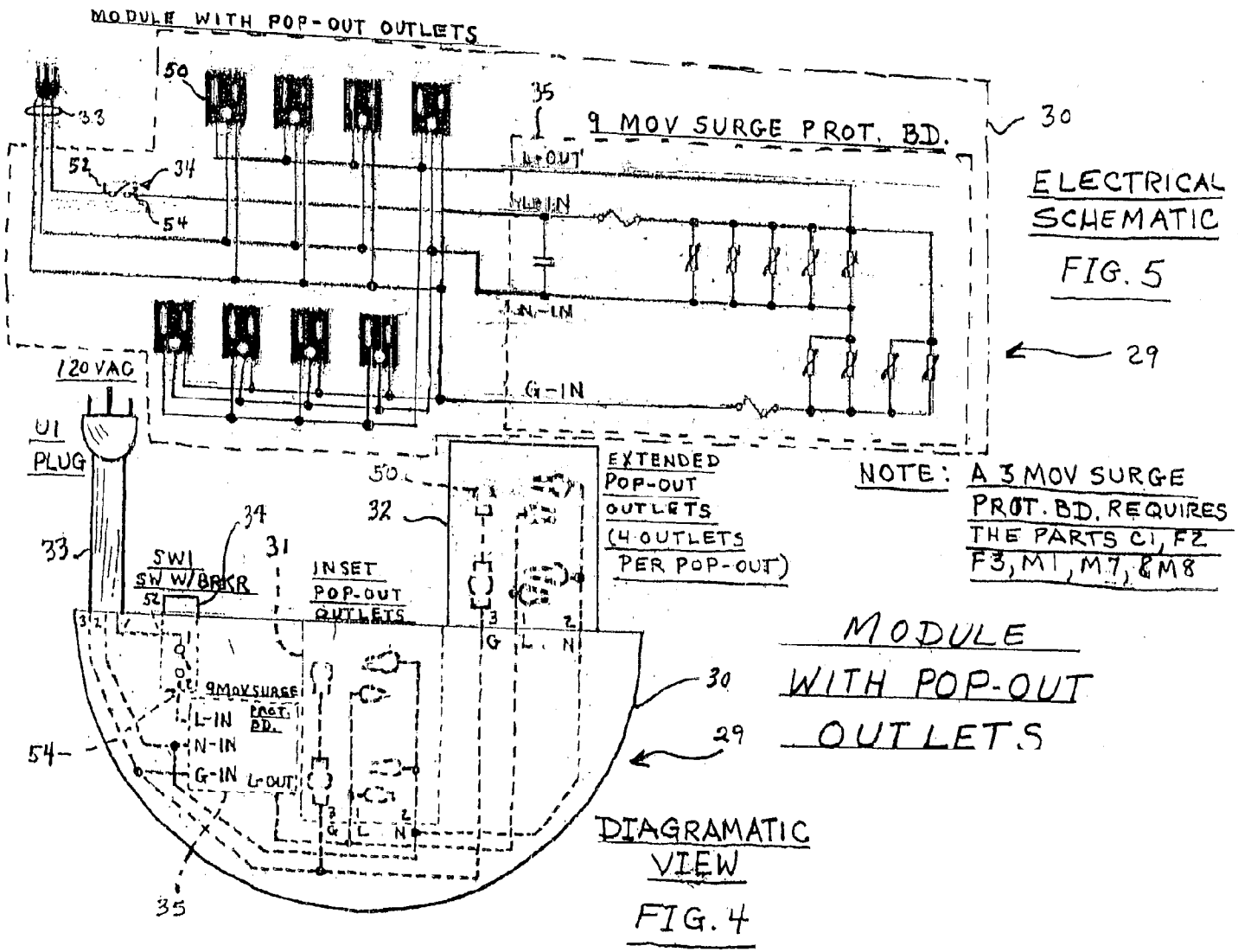
FIG. 4 is a diagrammatic view of the construction shown in FIG. 2.
FIG. 5 is an electrical schematic showing the electrical connections for the construction shown in FIG. 4.

The base unit 29 has a housing 30, a first pop-out outlet 31, and a second pop-out outlet 32. A line cord 33 provides power to the device and is connected through on/off switch 34 to a surge protection device 35 (FIGS. 4 and 5). Additional snap-in or slide-in housing portion modules may be provided in openings (40, 41) in a rear panel 30*a* if desired.

The surge protection device 35 protects ground and/or the hot and neutral connectors or wires.

Referring now to FIG. 4, there is shown a diagrammatic view of the base unit 29 which comprises the housing 30, the electrical power cord 33, the power on/off switch with breaker 34, the surge protector board 35, the two pop-out outlet modules 31 and 32, and the associated wiring.

To operate, the base unit 29 receives power from the attached power cord 33 which is connected to a 120 volt alternating current power source. Internally, the signal is connected to an input connection 52 of the power switch 34 which allows the user to turn power on or off to the base unit 29. From this point on the incoming neutral and ground signals, along with the hot signal from a power switch 34 output connection 54, are connected to the surge protector board 35, and then passed on to the two pop-out outlet modules 31, 32.

To protect external electrical equipment from power surges, a user could connect a power cord from the external electrical equipment into a pop-out power outlet, for example, 50. If a surge is detected in the wiring, the surge protector board 35 will direct that surge to ground before the surge can damage the external equipment.

Next referring to FIG. 5, there is shown the electrical schematic of the base unit 29. Power enters the base unit through the power cord 33. The hot signal is wired to the input connection 52 of the power switch 34. Then the incoming neutral and ground signals, along with the hot signal of the output connection 54 of the power switch 34, are passed onto the pop-out outlets 31, 32, and the surge protector board 35. To use the present invention a user could connect external electrical equipment into a pop-out power outlet, for example, the outlet 50. If a surge is detected in the wiring, the surge protector board 35 will direct that surge to ground before the surge can damage the external equipment.

Figure 6A:
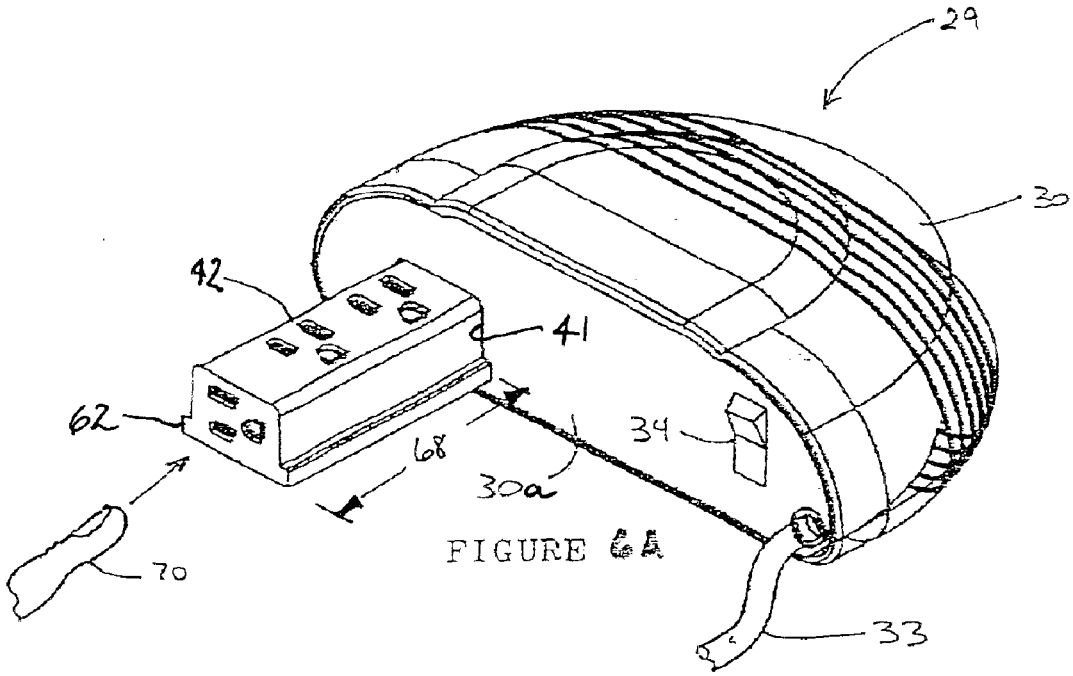
FIG. 6A is a perspective view of a construction embodying the present invention.
Figure 6B:
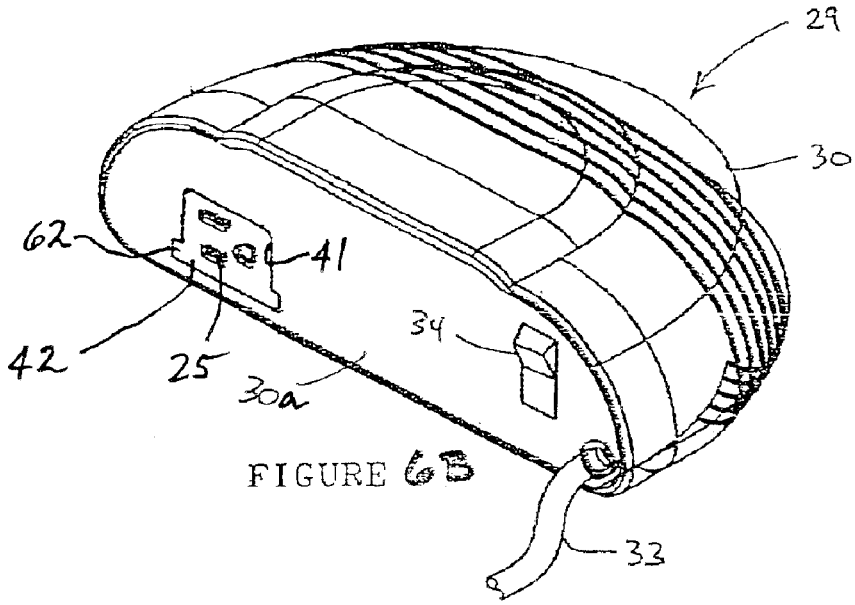
FIG. 6B is a perspective view of an alternative condition of the construction shown in FIG. 6A.
Figure 7:
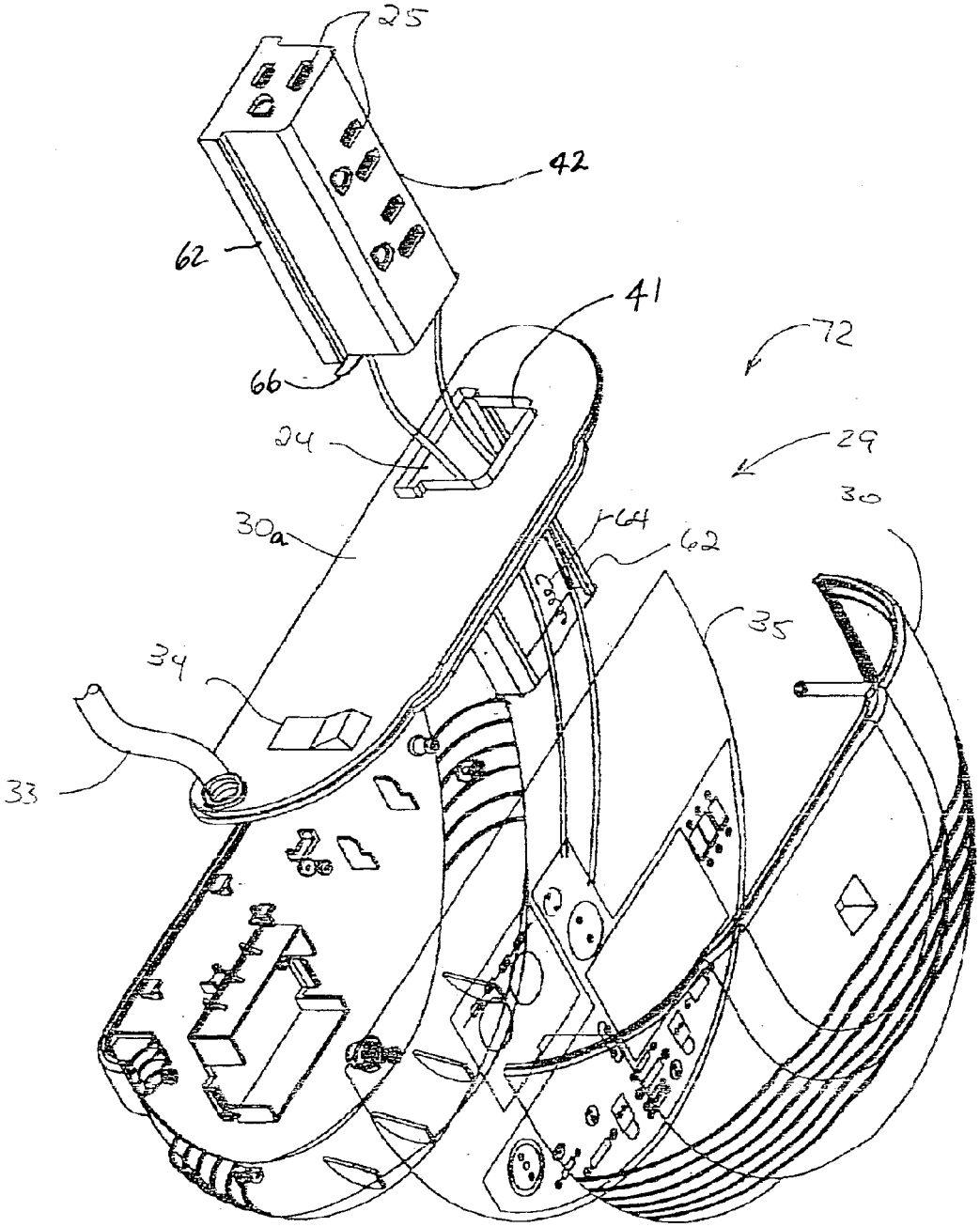
FIG. 7 is an exploded perspective view of the construction shown in FIG. 6A.
Figure 7A:
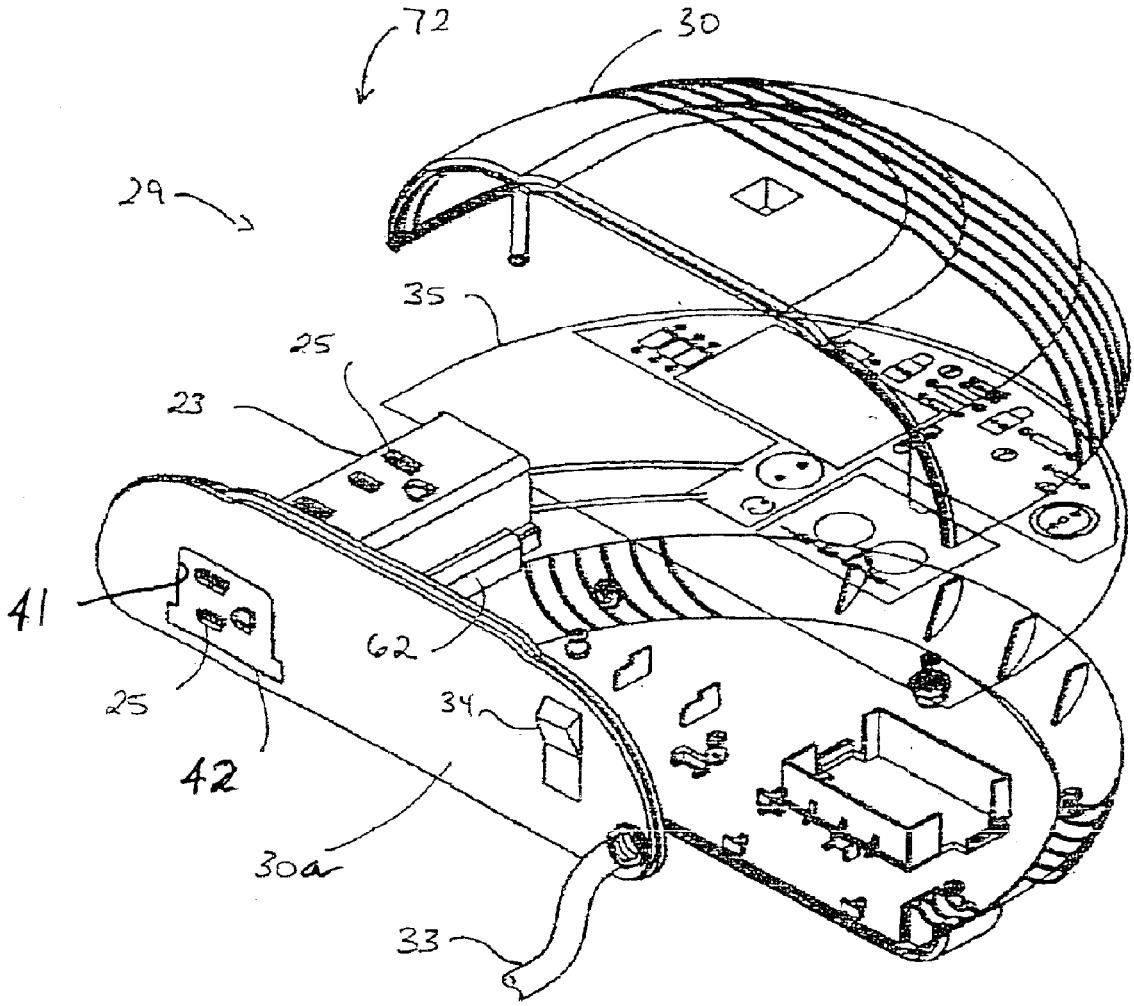
FIG. 7A is an exploded perspective view of an alternative condition of the construction shown in FIG. 7.

As depicted in FIGS. 6A, 6B, 7 and 7A, an extendable housing portion 42 may slide in and out of the opening 41 on complementary rails 62 provided in the housing 30 and on the housing portion 42 by means well known in the art, and may have a spring loaded pop-out feature 64, or may simply be extended and retracted like a common drawer in the housing 30. The pop-outlets 31 and 32 and the opening 40 are not shown in these views. The housing portion 42 has at least one stop 66 in mechanical communication with the housing 30 to prevent the extendable housing portion 42 from extending beyond a predetermined distance 68 from the housing 30 as shown in FIG. 7. Preferably, manual means 70, such as a human finger, are used to locate the extendable housing portion 42 back into the housing 30. As depicted in FIGS. 6B and 7A, at least one outlet or connector 25 is preferably accessible when the extendable housing portion 42 is retracted in the housing 30, however, embodiments where the outlet or connector 25 is not accessible are also well within the scope of the invention.

Suitable electrical connections as depicted in FIGS. 4 and 5, also well known in the art, are provided in the housing to connect the outlets or connectors 25 to the surge protection circuitry 35 which may be provided in the housing 30, and, in turn, to the line cord 33.

FIGS. 11–14 depict an alternative embodiment electronic housing device 72 of the present invention wherein the extendable housing portion 42, as described above, swings or rotates into and out of an opening 44 in a rear panel 30*b* of the housing 30 on at least one hinge 74. The extendable housing portion 42 may be hinged on either end to allow the housing portion to swing out from either side of the opening 44. Additionally, although the extendable housing portion 42 is depicted as swinging out in a substantially horizontal fashion, it is well within the scope of the invention to allow the extendable housing portion 42 to be hinged at either its top or bottom. Hinges at the top or bottom of the extendable housing portion 42 allow it to swing into and out of the housing along a substantially vertical plane. The extendable housing portion 42 may have at least one of the outlet or connector 25 accessible when the extendable housing portion 42 is located within the housing 30.

Manual or automated means may be used to extend the extendable housing portion into and out of the housing.

Thus by carefully studying the problems existing in present day electrical devices, a novel apparatus is provided for providing additional electrical connectors or outlets.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An electronic housing device comprising:

a housing for enclosing electronics and having an opening formed therein;

a line cord attached at one end to said housing and having an opposite end adapted to be connected to a source of electrical power;

a first electrical connector supported on said housing and being accessible;

an extendable housing portion mounted in said opening and being selectively moveable into and out of said housing, said housing and said extendable housing portion having complimentary rails to guide said extendable housing portion during movement into and out of said housing; and a second electrical connector mounted on said extendable housing portion, said second electrical connector being accessible when said extendible housing portion is extended out of said housing and not being accessible when said extendable housing portion is retracted into said housing.

2. The device according to claim 1 wherein said second electrical connector is one of a three-prong electrical power outlet, a RJ11 connector, a RJ45 connector and a co-ax connector.

3. The device according to claim 1 wherein said housing has a stop preventing said extendable housing portion from extending beyond a predetermined distance from said housing.

4. The device according to claim 1 including a spring loaded pop-out feature for urging said extendable housing portion from said housing.

5. The device of claim 1 wherein said first electrical connector is mounted on an exposed end of said extendable housing portion.

6. The device according to claim 1 wherein said line cord, said first electrical connector and said second electrical connector are connected to a surge protection device.

7. The device according to claim 1 wherein said line cord has hot, neutral and ground wires and said second electrical connector is said three-prong electrical power outlet connected to said hot, neutral and ground wires.

8. The device according to claim 7 wherein said first electrical connector is a three-prong electrical power outlet connected to said hot, neutral and ground wires.

9. An electronics housing device comprising:

an enclosed housing having at least one opening formed therein;

at least two accessible electrical connectors mounted on said housing;

an extendable housing portion mounted in said at least one opening and being selectively extensible in a horizontal direction from and retractable into said housing; and at least two additional electrical connectors mounted on said extendable housing portion, at least one of said two additional electrical connectors being accessible when said extendable housing portion is extended out of said housing and not being accessible when said extendable housing portion is retracted into said housing, said at least one electrical connector being mounted in a top surface of said extendable housing portion.

10. The device according to claim 9 wherein said at least two accessible electrical connectors are three-prong electrical power outlets.

11. The device according to claim 9 wherein said at least two additional electrical connectors are three-prong electrical power outlets.

12. The device according to claim 9 wherein said housing and said extendable housing portion have complimentary rails to guide said extendable housing portion during. movement into and out of said housing.

13. The device according to claim 9 wherein said housing has a stop preventing said extendable housing portion from extending beyond a predetermined distance from said housing.

14. The device according to claim 9 including a spring loaded pop-out feature for urging said extendable housing portion from said housing.

15. The device according to claim 9 wherein said at least two accessible electrical connectors and said at least two additional electrical connectors are connected to a surge protection device.

16. An electrical power outlet and surge protection device comprising:

a housing having at least one opening formed therein;

a first plurality of electrical power outlets mounted on said housing and being accessible;

an extendable housing portion mounted in said at least one opening and being selectively extensible in a horizontal direction from and retractable into said housing; and a second plurality of electrical power outlets mounted on said extendable housing portion and being accessible when said extendable housing portion is extended out of said housing and not being accessible when said extendable housing portion is retracted into said housing, said second plurality of electrical power outlets being mounted in a top surface of said extendable housing portion.

17. The device according to claim 16 wherein said first and second pluralities of electrical power outlets are connected to a surge protection device in said housing.

18. The device according to claim 16 wherein said housing and said extendable housing portion have complimentary rails to guide said extendable housing portion during movement into and out of said housing.

* * * * *